United States Patent [19]

Pfeiffer et al.

[11] 4,316,714

[45] Feb. 23, 1982

[54] APPARATUS FOR PREPARING OPEN STRUCTURE FIBERS

[75] Inventors: Ronald E. Pfeiffer, Pensacola; Francesco DeMaria, Gulf Breeze, both of Fla.

[73] Assignee: American Cyanamid Company, Stamford, Conn.

[21] Appl. No.: 13,344

[22] Filed: Feb. 21, 1979

[51] Int. Cl.[3] ..... A01J 21/02

[52] U.S. Cl. ..... 425/382.2; 264/177 F; 425/466; 425/467

[58] Field of Search ..... 264/177 F, 171; 425/DIG. 217, 464–467, 382.2

[56] References Cited

U.S. PATENT DOCUMENTS

| | | | |
|---|---|---|---|
| 1,618,256 | 2/1927 | Wuthrich | 425/467 |
| 2,999,296 | 9/1961 | Breen et al. | 264/177 F |
| 3,075,242 | 1/1963 | Grafried | 264/171 |
| 3,095,258 | 6/1963 | Scott | 264/177 F |
| 3,121,254 | 2/1964 | Heynen et al. | 264/171 |
| 3,242,531 | 3/1966 | Nohl | 264/171 |
| 3,252,181 | 5/1966 | Huveau | 264/465 |
| 3,436,789 | 4/1969 | Hays | 264/39 |
| 3,438,087 | 4/1969 | Attfield et al. | 425/DIG. 217 |
| 3,439,381 | 4/1969 | Plomp | 264/177 F |
| 3,540,080 | 11/1970 | Goossens | 264/171 |
| 3,587,281 | 6/1971 | Lemelson | 425/467 |

FOREIGN PATENT DOCUMENTS

| | | | |
|---|---|---|---|
| 143206 | 6/1881 | France | 264/177 F |
| 38-12366 | 7/1963 | Japan | 264/177 F |
| 43-30025 | 12/1968 | Japan | 264/171 |
| 44-2048 | 1/1969 | Japan | 264/177 F |
| 45-15804 | 6/1970 | Japan | 264/177 F |
| 47-31365 | 8/1972 | Japan | 264/177 F |
| 362791 | 8/1962 | Switzerland | 264/177 F |
| 891464 | 3/1962 | United Kingdom | 264/177 F |

*Primary Examiner*—Jay H. Woo

*Attorney, Agent, or Firm*—Frank M. Van Riet

[57] ABSTRACT

Use of special pin insert in the counterbore-orifice combination of a conventional spinnerette plate provides open structure fibers.

2 Claims, 5 Drawing Figures

APPARATUS FOR PREPARING OPEN STRUCTURE FIBERS

Figure 1:
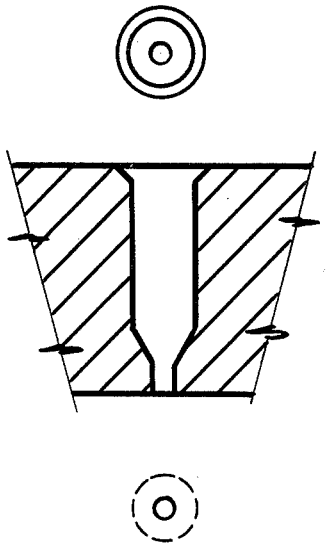

This invention relates to apparatus for forming fiber having an open cross-sectional shape. More particularly, this invention relates to such apparatus useful in preparing fibers of open cross-section from a fusion melt of acrylonitrile polymer and water.

Recent developments in the art of spinning acrylonitrile polymer fiber have lead to a fusion melt spinning procedure. In this procedure, an acrylonitrile polymer and water in proper proportions are heated to a temperature above the boiling point of water at atmospheric pressure and under sufficient pressure to maintain water in liquid state. At appropriate temperature and pressure a homogeneous fusion melt of polymer and water will form at a temperature below the deterioration temperature of the polymer and at a temperature below which the polymer would normally melt. In preferred embodiments this fusion melt is extruded through a spinnerette directly into a steam-pressurized solidification zone maintained under conditions which prevent sheath-core structure in the cross-section of the nascent filament and enable stretching to provide orientation of the polymer molecules to be accomplished while said extrudate remains with the solidification zone. This process provides a rapidly solidified extrusion composition which upon exit from the spinnerette shows no tendency towards stickiness and high conformity to the shape of the spinnerette orifices through which it is spun.

Fibers having open cross-sectional shape are desirable for a number of reasons. Because of their open structure, such fibers have a higher extent of surface area than do conventional shaped fibers. This high surface area consists of both external surface area and internal surface area of the open structural modification. This high surface area permits increased adsorption of water, dyes and other adsorbable materials. Increased water adsorption provides greater comfort in wearing fabrics made from such fiber. The open structure also provides greater bulk than conventional fiber of the same denier. Esthetic qualities such as handle or feel are also desirably altered by the open structure and suitable structures can provide greater cover in fabric constructions than conventional round structures of the same denier. Fabrics constructed from the open structure fiber dry quicker than closed structure fiber because of their greater surface area. Thus, although the desirability of open structure fibers is generally recognized, suitable apparatus for preparing such fiber has been difficult to provide and limited fiber of open structure has become available.

Spinnerettes useful in providing open structure fiber are extremely difficult to construct and require extremely expensive techniques to fabricate. Because of these restrictions very limited production of open structure fiber has been evidenced. What is needed is an apparatus for spinning open structure fibers that is easily constructed and enables wide variations in the types of open structure fibers provided. Such a provision would fulfill a long-felt need and constitute a significant advance in the art.

In accordance with the present invention, there is provided a spinnerette assembly for spinning open structure fibers which comprises in combination:

a. a spinnerette plate containing a plurality of orifices with a counterbore for each orifice and b. removable pins positioned within each orifice-counterbore combination, each pin being of solid construction and having an upper portion positioned within said counterbore and a lower portion positioned within said orifice, said upper portion occupying a fixed position within said counterbore and enabling spinning composition to flow through the counterbore to the orifice at operative back pressure and said lower portion contacting the wall of the orifice at one position while providing clearance at other positions and having suitable shape characteristics to provide the desired open structure in the extrudate formed.

The spinnerette assembly provided by the present invention is readily fabricated since it employs a conventional type spinnerette plate and easily prepared pins for insertion therein. The spinnerette assembly when utilized with a fusion melt of acrylonitrile polymer and water enables a wide variety of open structure fibers to be obtained by suitable selection of spinnerette plate and pin inserts since the polymer-water extrudate quickly solidifies to retain the shape imparted by the spinnerette orifices after extrusion. In a preferred embodiment, the extrudates of acrylonitrile polymer and water are spun directly into a steam-pressurized solidification zone which prevents formation of a sheath-core structure and enables the extrudate to be stretched to provide orientation of the polymer molecules.

Figure 2:
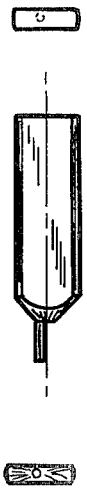
Figure 3:
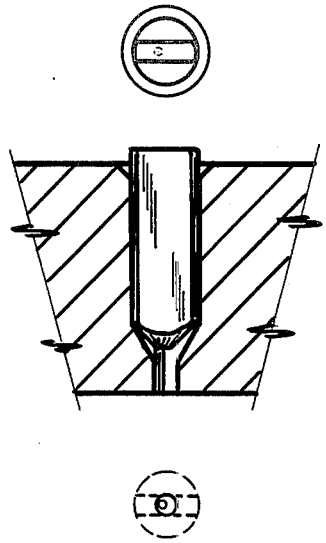
Figure 4:
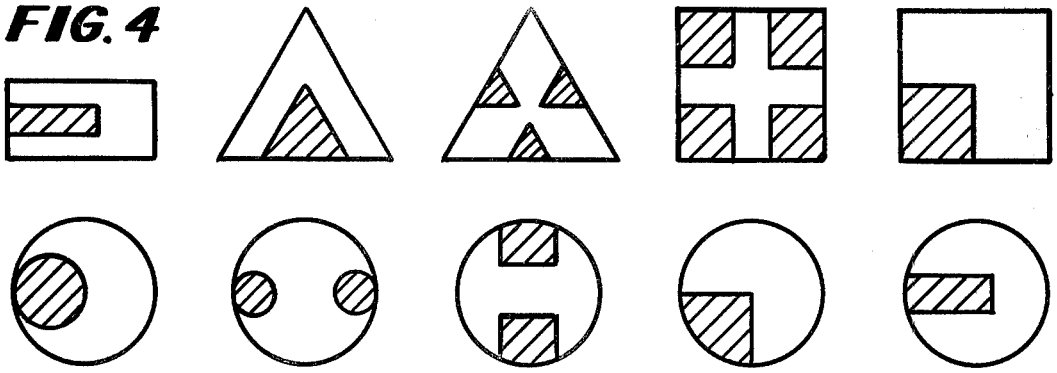

The invention is more fully described with reference to the accompanying drawing wherein FIG. 1 represents a cross-section of a portion of a spinnerette plate showing a single counterbore and orifice as well as a top and bottom view thereof, FIG. 2 represents a side view of a typical insertion pin as well as top and bottom views thereof, FIG. 3 represents a cross-section of a single counterbore and orifice with insertion pin positioned therein as well as a top and bottom view thereof, and FIG. 4 represents the bottom view of a number of shaped orifices having a variety of shaped pins inserted therein.

Figure 5:
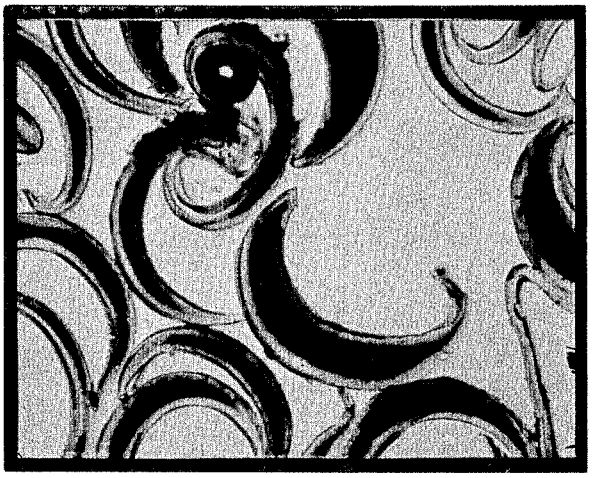

FIG. 5 is a photomicrograph of cross-sections of a crescent-shaped fiber produced as in Example 1.

In providing the spinnerette assembly of the present invention, a conventional type spinnerette is employed. The spinnerette plate will contain a plurality of orifices and a counterbore associated with each orifice. The spinnerette plate may have orifices of any shape that can be fabricated and will be of a material of construction useful in melt-spinning applications. Counterbores are necessary to provide operative back pressure and should be large enough to enable the pin insert modification to obtain operative back pressure.

Pins are provided for insertion in the counterbore-orifice combination to provide extrudates having open structure. These pins are designed so that they are of solid construction and occupy a fixed position within the counterbore. The pins will be of such size as to enable extrusion composition to flow through the counterbores at operative back pressure to the orifice. The pins will typically have an upper portion which fits into the counterbore and a lower portion which fits into the orifice. The upper portion will be of suitable dimensions to assume a fixed position within the counterbore so that the lower portion remains suitably disposed in the orifice to provide the open structure fiber and enable adequate flow of extrusion composition through the counterbore and capillary. The lower portion of the pin will be of suitable dimensions to fit within the orifice and contact a portion of the wall thereof while providing a desirable relationship between fiber wall and open structure therein.

A preferred embodiment of the invention is that shown with reference to FIGS. 1, 2, and 3. FIG. 1 represents a cross-section of a typical counterbore orifice combination used in a conventional spinnerette plate, as well as top and bottom views thereof. The counterbore has a greatly enlarged diameter relative to that of the orifice and converges to the orifice diameter with proper sloping. FIG. 2 represents a side view of a preferred pin insert to provide open structure fibers when inserted within the counterbore-capillary combination as well as top and bottom views thereof. As can be seen, the upper portion of the pin resembles a cylindrical rod which has been flattened along its length to provide clearance on two sides with the counterbore. The top of the upper portion is beveled while the bottom thereof is tapered at a greater angle than the taper of the counterbore to connect the orifice and thus provide clearance for the extrusion material. The bottom portion of the pin has a solid cross-sectional shape that conforms to the shape of the orifice on one face which is positioned so as to contact a portion of the wall of the orifice and has additional shape to provide desirable open area within the extrudate issuing from the orifice and provide suitable fiber cross-sectional structure. In FIG. 3, the insertion of the pin of FIG. 2 in the counterbore-capillary combination of FIG. 1 is shown in cross-section along with top and bottom views thereof. Clearance of the pin from the counterbore wall is shown in the top view and clearance between the tapers of the pin and counterbore are shown in the cross-section. In the bottom view the space in the orifice occupied by the pin insert is shown and the resulting cross-sectional shape of the extrudate can be seen.

In FIG. 4 is shown a variety of orifice shapes with various shapes of the lower portion of the insert pin that can be used in providing open structure fibers. As can be seen, the pin shape may vary widely as the orifice shape. Also, it is possible to provide one or more open areas within the fiber by use of multiple porjections as the lower portion of the pin insert.

The spinnerette assembly of the present invention is preferably employed using a fusion melt of a fiber-forming acrylonitrile polymer and water. This composition is formed by heating proper amounts of polymer and water at autogeneous pressure and a temperature above the boiling point of water at atmospheric pressure in a suitable extruder. The extruder forces the homogeneous single phase fusion melt through a spinnerette assembly equipped with the spinnerette plate and pin inserts described above. Extrusion is preferably carried out so that the nascent extrudate enters directly into a steam-pressurized solidification zone maintained under conditions which prevents formation of a sheath-core structured fiber and enables orientation stretching of the extrudate to be accomplished while the extrudate remains in the solidification zone.

After the extrudate leaves the solidification zone, it is preferably dried under proper conditions of dry and wet bulb temperatures to minimize void formation in the resulting fiber and relaxed in steam. The fiber can be provided in textile deniers with desirable physical properties for such use.

The invention is more fully exemplified in the examples which follow wherein all parts and percentages are by weight unless otherwise specified.

EXAMPLE 1

A conventional spinnerette plate having a plurality of orifices of 200 micron diameter was fitted with insert pins as shown in FIG. 3. Each pin was 175 micron diameter resulting in free area remaining in the individual capillaries of about 7,363 square microns.

An acrylonitrile polymer of the following composition was employed:

| | |
|---|---|
| Acrylonitrile | 85% |
| Methyl methacrylate | 11.9% |
| Poly(vinyl alcohol) | 3.0% |
| Acrylamidomethylpropanesulfonic acid | 0.1% |

The polymer had a kinematic molecular weight of 42,000. Kinematic molecular weight ($\overline{M}_k$) is determined from the viscosity measurement of a 1% solution of the polymer in 50% sodium thiocyanate at 40° C. using the formula: $\overline{M}_k = V \times 10{,}500$, where V is the absolute viscosity on centipoise (after correction for viscometer constant).

A mixture of 83 parts of the polymer, 17 parts water and 0.25 parts of a conventional glycol stearate type lubricant was converted into a fusion melt in an extruder at 175° C. and autogeneous pressure and extruded through the spinnerette plate prepared as described above. Extrusion was directly into a steam pressurized solidification chamber maintained at 13 pounds per square gauge with saturated steam. The filaments were stretched at a ratio of 3× to give a fiber of about 40 d/f that had cross-section shapes as shown in FIG. 5, which shape is termed crescent-shaped.

We claim:

1. A spinnerette assembly for spinning open structure fibers which comprises in combination a. a spinnerette plate containing a plurality of orifices with a counterbore for each orifice and b. removable pins positioned within each orifice-counterbore combination, each pin being of solid construction and having an upper portion positioned within said counter-bore and a lower portion positioned within said orifice, said upper portion occupying a fixed position within said counterbore and enabling spinning composition to flow through the counterbore to the orifice at operative back pressure and said lower portion contacting the wall of the orifice at one position while providing clearance at other positions and having suitable shape characteristics to provide an open structure in the extrudate formed.

2. The spinnerette assembly of claim 1 wherein said pin has an upper portion which resembles a cylindrical rod which has been flattened along its length to provide clearance on two sides with the counterbore, is beveled at the top and is tapered at the bottom at a greater angle than the taper of the counterbore and the bottom portion is shaped to contain a portion of the orifice wall and provide a desirable open structure in the extrudate.

* * * * *